US007658424B2

(12) United States Patent
Sviland

(10) Patent No.: US 7,658,424 B2
(45) Date of Patent: Feb. 9, 2010

(54) LIFTING HOOK DEVICE

(76) Inventor: Per Sviland, Sygnaveien 48, Sviland, Sandnes (NO) N-4308

( * ) Notice: Subject to any disclaimer, the term of this patent is extended or adjusted under 35 U.S.C. 154(b) by 126 days.

(21) Appl. No.: 10/599,738

(22) PCT Filed: Apr. 1, 2005

(86) PCT No.: PCT/NO2005/000111

§ 371 (c)(1),
(2), (4) Date: Mar. 11, 2008

(87) PCT Pub. No.: WO2005/097659

PCT Pub. Date: Oct. 20, 2005

(65) Prior Publication Data

US 2008/0265597 A1 Oct. 30, 2008

(30) Foreign Application Priority Data

Apr. 6, 2004 (NO) ..... 20041439

(51) Int. Cl.
*B66C 1/36* (2006.01)

(52) U.S. Cl. ..... 294/82.23

(58) Field of Classification Search ..... 294/82.23; 24/600.2, 600.8
See application file for complete search history.

(56) References Cited

U.S. PATENT DOCUMENTS 1,521,811 A * 1/1925 Hartbauer ..... 24/600.8
1,533,995 A * 4/1925 Lang ..... 294/82.21
1,679,902 A * 8/1928 Helwig ..... 24/600.8
3,859,693 A * 1/1975 Breed ..... 294/82.23

FOREIGN PATENT DOCUMENTS

EP 0 059 228 A1 9/1982

* cited by examiner

*Primary Examiner*—Paul T Chin
(74) *Attorney, Agent, or Firm*—Akerman Senterfitt

(57) ABSTRACT

A hook (1) in a lifting device, where the hook is of the type where a lifting tool is placed in and released from the hook (1) through a hook opening (11), where the hook (1) is provided with a locking bolt (15) arranged to be displaced in the longitudinal direction for closing of the hook (1) opening (11), and where the hook (1) locking bolt (15) is locked into position when the hook opening is closed. The lock is released and the locking bolt (15) can be displaced away from the hook opening (11) by means of an actuating lever (9) arranged in the body (3) of the hook.

5 Claims, 4 Drawing Sheets

LIFTING HOOK DEVICE

The present invention regards a lifting component of a lifting device. More particularly, it concerns a lifting hook provided with a locking bolt that will prevent a lifting tool placed in the hook from inadvertently being released from the book.

The object of the invention is to provide a lifting hook, hereinafter termed a "hook", that fulfils the authorities' requirements concerning safety devices required to prevent inadvertent separation of hook and lifting tool, and is also satisfactory in terms of providing simple and safe control of the safety device when placing the lifting tool in the hook and detaching the lifting tool from the hook.

The term lifting tool is used herein to describe components or equipment used between a lifting device and the load to be lifted or pulled.

In order to prevent a lifting tool from detaching from a hook it is known to provide the hook with a safety device comprised of a spring loaded catch that covers or projects across the hook opening, and which is arranged to be pivoted inwards in the hook opening only. An alternative solution is also known, in which the catch forms a fixed part of the hook suspension, and where the hook may be rotated and locked about its own axis.

There are several disadvantages associated with the above prior art. In order to free up the hook opening, an operator needs to exert a force on the spring loaded catch to make it turn inwards in the direction of the hook. With large hooks especially, this represents a considerable force that must be applied to the catch, which is hard work for the operator. In addition, the handling of the catch entails a risk of injuries such as crushing, as the catch must normally be pressed inwards while detaching the lifting tool from the hook. The prior art catch closes the hook opening by use of spring loading only. Thus in some cases the lifting tool may force the catch into the open position, whereby the lifting tool may detach from the hook in an uncontrolled manner.

The object of the invention is to remedy or at least reduce one or more of the disadvantages of prior art.

The object is achieved by the characteristics stated in the description below and the in the following claims.

In one aspect the present invention is constituted by a hook in a lifting device, where the hook is provided with a safety device in the form of a rod element that may be displaced with respect to the hook, hereinafter termed a "locking bolt", which is arranged to close the hook opening in such a way that the lifting tool can not be detached from the hook in an uncontrolled manner.

In a preferred embodiment the locking bolt moves in its longitudinal direction in an essentially complementary bore through a portion of the body of the hook, so that a portion of the locking bolt may project from the body of the hook at a portion of the hook opening and be moved into abutment against the "pointed" end portion of the hook. In an alternative embodiment the locking bolt may move in a sleeve portion fixed to the hook body instead of a bore through the hook body such as described above.

In a preferred embodiment the locking bolt is provided with spring loading that pre-tensions the locking bolt into abutment against the end portion of the hook, i.e. the locking bolt closes off the hook opening.

In order to reduce the risk of injury, the locking bolt is arranged so as to allow a force acting against the spring loading force to be applied to an area outside the hook opening. In its simplest form the force is applied by pulling on a part, or a body connected to a part, of the locking bolt at the opposite end from the hook opening. In a preferred embodiment the force is applied through a force acting, in the operative position, essentially in the downward direction, which force is applied to an element hereinafter termed "actuating element", which is connected to the locking bolt via a connecting element formed by any suitable element such as a chain or rope made from an appropriate material.

In order to guard against the locking bolt inadvertently moving out of the hook opening so as to allow the lifting tool to be taken out through the hook opening, the locking bolt is in a preferred embodiment provided with a locking device arranged so as to be capable of preventing movement of the locking bolt. In a preferred embodiment the locking device comprises a locking pawl placed in a recess in the locking bolt, where a part of the locking pawl is arranged upon rotation to project from said recess in the locking bolt. When the locking bolt is moved in a direction that increases the hook opening, hereinafter termed return motion, a part of the projecting locking pawl will, in a manner that is known per se, be placed against a part of the bolt body by the bore in which the locking bolt is moving, thus preventing any further return motion. Preferably the locking pawl is provided with a pre-tensioning device that drives the locking pawl to the "open" position. When the need for return motion of the locking bolt arises the locking pawl must be rotated to the "closed" position, so that the locking pawl is essentially in the locking bolt recess, and the part of the locking bolt which projects from the hook opening can be pulled into the bore.

In one embodiment the locking pawl is forced into the locking bolt recess e.g. by hand while applying a return force to the locking bolt. However, for practical and security reasons it is desirable for the return motion of the locking bolt to take place in one single operation. Thus in a preferred embodiment the locking pawl and the actuating element for the return motion of the locking bolt are interconnected via a connecting element in a manner which ensures that upon application of a tensile force to the connecting element the locking pawl will rotate about its connection point to the locking bolt and then be pulled into the recess in the locking bolt, so as to allow the locking bolt to be pulled into the bore and thereby open the hook opening.

The hook and its components can be made from any appropriate material. In a preferred embodiment some or all of the components of the hook are made from a corrosion resistant material.

The following describes a non-limiting example of a preferred embodiment illustrated in the accompanying drawings, in which.

Figure 1:
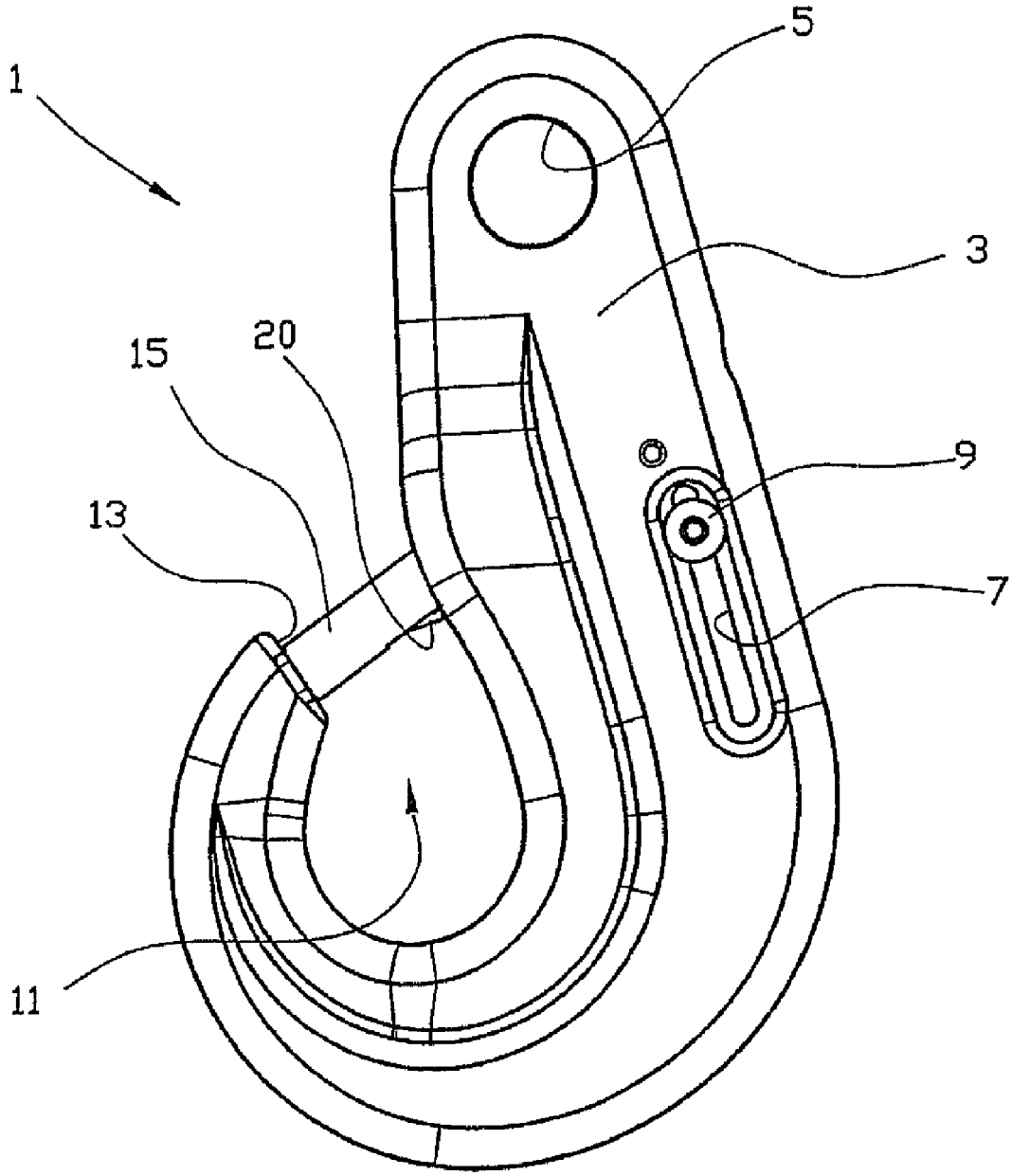
FIG. 1 is a view of a hook according to the invention in which the hook opening is closed by a locking bolt.
Figure 2:
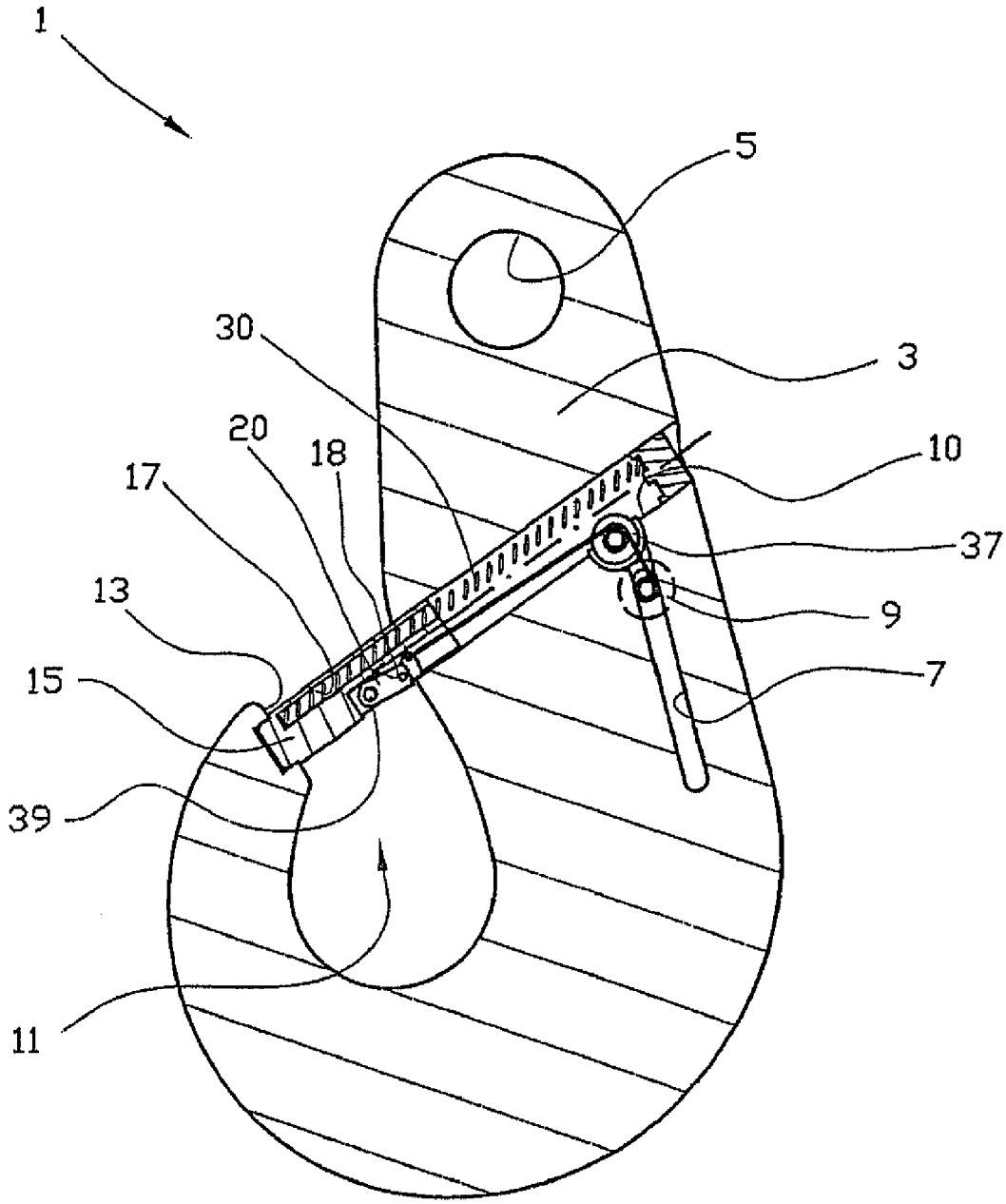
FIG. 2 shows a partial section through the hook of FIG. 1.
Figure 3:
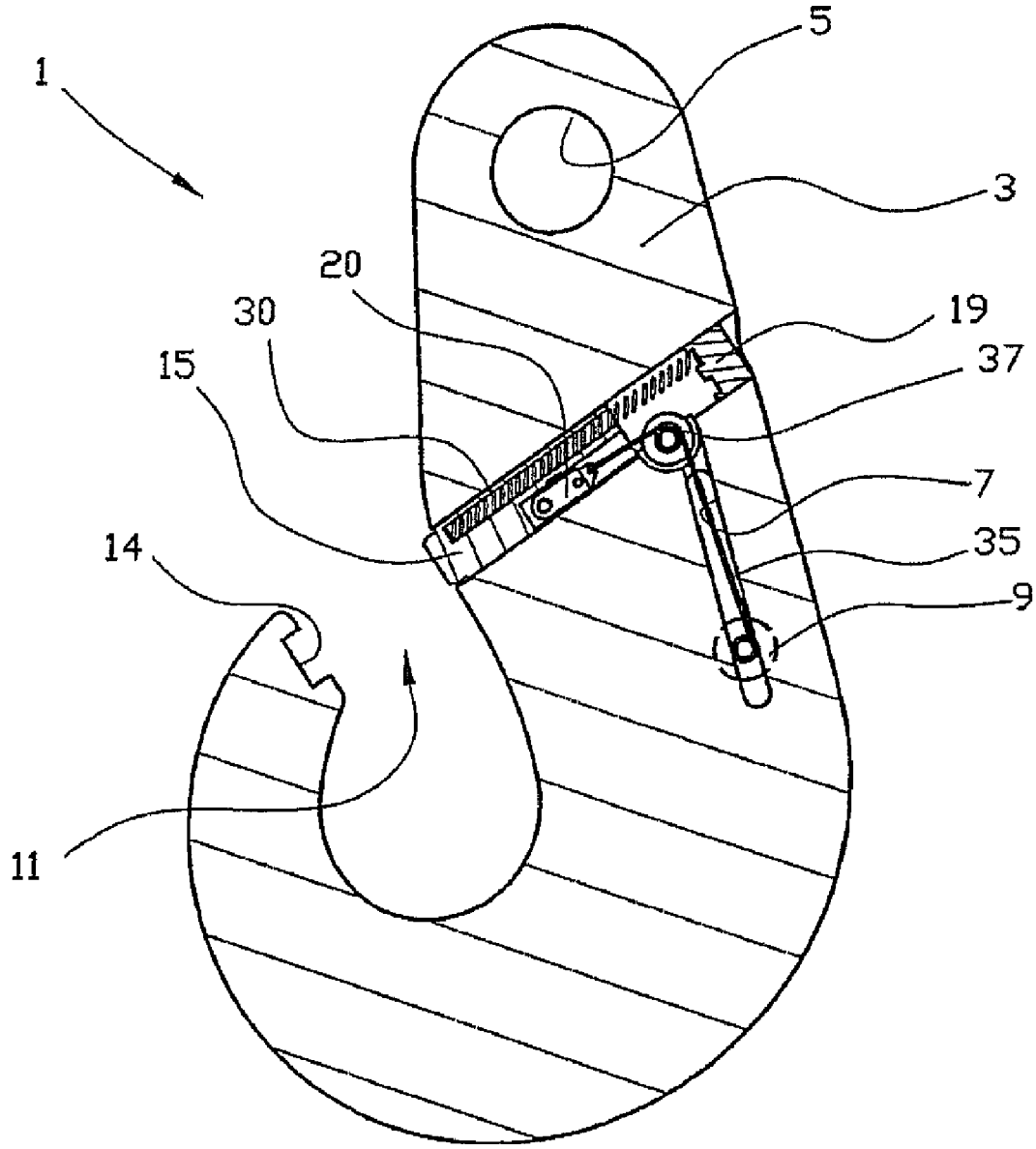
Figure 4:
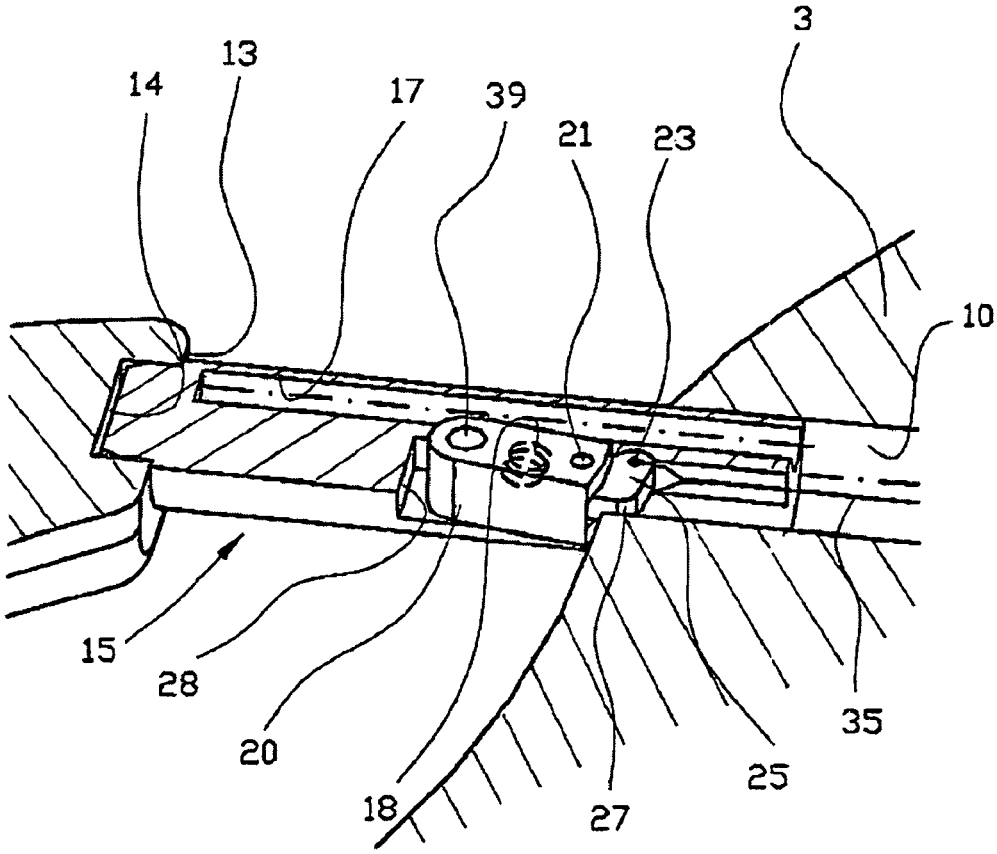

FIG. 3 shows a partial section through a hook as shown in FIG. 1, but where the locking bolt has been pulled into the body of the hook by means of an actuating lever partially integrated into the body of the hook; and FIG. 4 shows an enlarged and partially sectioned view of the locking bolt shown in FIG. 2. For clarity, the spring that pre-tensions the locking bolt to the closed position is not shown in FIG. 4, while the spring that pre-tensions the locking pawl is indicated by broken lines.

In the drawings reference number 1 denotes a hook comprising a hook body 3 provided with a lifting eye 5 and an elongated through slot 7 in which a through-going actuating lever 9 can be moved in order to pull a locking bolt 15 into the body 3 of the hook, so as to free up the opening 11 of hook from the locking bolt 15.

In FIGS. 1 and 2 a portion of the locking bolt 15 projects from a bore 10 through the body 3 of the hook, abutting a depression 14 in the pointed end portion 13 of the hook body 3. The locking bolt 15 is prevented from inadvertently returning into the bore 10 of the hook body 3 by a portion of a locking pawl 20 projecting from a locking pawl recess 28 in the body of the locking bolt 15 and a portion of an end face of the locking pawl 20 abutting a portion of the outside of the hook body 3 at the bore 10 opening. The locking pawl 20 is provided with a spring 18 that, in a manner that is known per se, applies pre-tension to the locking pawl 20 so as to make it rotate about a fixing shaft 39, a portion of the locking pawl 20 between the fixing shaft 39 and the protruding end of the locking pawl being subjected to a compressive force from the spring 18.

A spring 30 pre-tensions the locking bolt 15 into abutment in a depression 14 at the end portion 13 of the body of the hook. The depression 14 has at least two functions; firstly the depression 14 helps steer the locking bolt 15 into an exact position in relation to the end portion 13 of the body of the hook and secondly, and most importantly, the depression 14 and the inside of the bore 10 provides a back stop against resultant forces acting at right angles to the longitudinal axis of the locking bolt 15.

In the embodiment shown, a portion of the spring 30 is placed in a blind bore 17 in the locking bolt 15. The spring 30 projects from the blind bore 17 into the bore 10 where, at its opposite end, it abuts a bore plug 19 rigidly mounted by means of e.g. a threaded connection (not shown) at the end of the bore 10.

When the need to pull the locking bolt 15 away from the hook opening 11 arises, the actuating lever 9 is moved down (relative to the operating position shown in the figures) in the through slot 7. The actuating lever 9 is interconnected with an actuating pawl 25 by means of a rope 35 (see FIG. 4), which actuating pawl 25 is rotatably connected to the locking pawl 20 by means of an axle 21. The rope 35 is attached to the actuating pawl 25 in a bore 23. The actuating pawl 25 has an essentially triangular shape, the axle 21 and the bore 23 being located in separate corners of the actuating pawl 25. Upon application of a downward force to the actuating lever 9 the rope 35 will exert a force that on the actuating pawl 25 will act in the bore 23. As shown in FIG. 2 the bore 23 is positioned above a straight line between the path of the rope 35 between a bearing element 37 and the fixing shaft 39 of the locking pawl. This eccentric positioning of the point of application of the rope 35 on the actuating pawl 25 will result in a component of force which will move the third corner portion 27 of the actuating pawl 25 into abutment against a part of the inside of the bore 10 and cause the actuating pawl 25 to rotate, so that the protruding portion of the locking pawl 20 is rotated about the fixing shaft 39 and into the locking pawl recess 17 of the locking bolt. When applying a force exceeding that of the spring 30 to the actuating lever 9 after the locking pawl has rotated into the locking pawl recess 28, the locking bolt 15 will be pulled into the bore 10, and open the hook opening 11 to allow lifting tools to be placed in or released from the hook 1.

When the external downward acting force applied to the actuating lever 9 becomes smaller than the force exerted by the spring 30, the spring 30 will drive the locking bolt 15 towards the end portion 13 of the body of the hook. As the locking pawl 20 comes out of the bore 10, the locking pawl spring 18 will again turn the locking pawl 20 to make it bar any return motion as described above.

The hook according to the invention provides a hook in which the locking bolt 15 is pre-tensioned and locked in the "closed" position, so that the lifting tool arranged in the hook can not be detached from the hook in an uncontrolled manner. The hook also provides an opening mechanism that is simple to operate with one hand, outside of the most hazardous handling area of the hook.

The invention claimed is:

1. A hook included in a lifting device, where the hook is of the type where a lifting tool is placed in and released from the hook through a hook opening, and where the hook comprises:

a locking bolt arranged to be displaced in a bore in a body of the hook between a first position in which the hook opening is open and a second position in which the hook opening is closed; and a locking device arranged to prevent the locking bolt from returning to the bore in an uncontrolled manner, wherein a portion of the locking device is arranged to abut a portion of the body of the hook outside the bore when the locking bolt is substantially in the second position, where the hook opening is closed, wherein the locking device is a locking pawl arranged to be pushed into a locking bolt recess by an applied resultant force that is opposite of and greater than the pre-tensioning force effected by a spring device, wherein the locking pawl is arranged to be driven into the locking bolt recess by a force transferred from an actuating lever via a rope, and wherein a actuating pawl is arranged between the locking pawl and the rope.

2. A hook according to claim 1, wherein the locking pawl is integrated and rotatably arranged in the recess in the locking bolt, and wherein the locking pawl is arranged to rotate about a locating point, whereby part of the locking pawl is rotated into and out of the recess.

3. A hook according to claim 2, wherein rotation of the locking pawl is effected by a spring arranged in the recess, wherein said spring pre-tensions the free end portion of the locking pawl so as to make it protrude from the recess.

4. A hook according to claim 1, wherein the locking bolt is spring loaded to abut a free end portion of the hook.

5. A hook according to claim 1, wherein the actuating lever is substantially integrated into a slot in the body of the hook.

* * * * *